US008939538B2

(12) United States Patent
Lux

(10) Patent No.: US 8,939,538 B2
(45) Date of Patent: Jan. 27, 2015

(54) LINER-FREE LABEL PRINTER WITH LABEL ADHESIVE ACTIVATION

(75) Inventor: Benjamin D. Lux, Providence, RI (US)

(73) Assignee: NuLabel Technologies, Inc., East Providence, RI (US)

( * ) Notice: Subject to any disclaimer, the term of this patent is extended or adjusted under 35 U.S.C. 154(b) by 233 days.

(21) Appl. No.: 13/566,959

(22) Filed: Aug. 3, 2012

(65) Prior Publication Data

US 2013/0033540 A1 Feb. 7, 2013

Related U.S. Application Data

(60) Provisional application No. 61/574,510, filed on Aug. 4, 2011.

(51) Int. Cl.

| | |
|---|---|
| ***B41J 2/015*** | (2006.01) |
| ***B41J 3/407*** | (2006.01) |
| ***B41J 11/00*** | (2006.01) |
| ***B41J 2/01*** | (2006.01) |
| ***B41J 13/00*** | (2006.01) |

(52) U.S. Cl.

CPC ..... *B41J 3/4075* (2013.01); *B41J 11/007* (2013.01); *B41J 2/01* (2013.01); *B41J 13/0045* (2013.01)

USPC ..... 347/16; 347/20; 347/21; 347/101

(58) Field of Classification Search

CPC ..... B41J 2/01; B41J 3/4075; B41J 3/543; B41J 3/60; B41J 11/007; B41J 13/0045

USPC ..... 347/20, 21, 95, 96, 101, 104, 105, 16, 347/27

See application file for complete search history.

(56) References Cited

U.S. PATENT DOCUMENTS

| | | | |
|---|---|---|---|
| 2,137,169 | A | 11/1938 | Levey |
| 3,206,348 | A | 9/1965 | Holstein |
| 3,865,671 | A | 2/1975 | Kronsder |
| 3,968,350 | A | 7/1976 | Watson |
| 4,090,662 | A | 5/1978 | Fayling |
| 4,203,798 | A | 5/1980 | Yamashita |
| 4,226,660 | A | 10/1980 | Carter |
| 4,279,687 | A | 7/1981 | Buchholz et al. |
| 4,347,095 | A | 8/1982 | Yamashita |
| 4,353,762 | A | 10/1982 | Bouda |

(Continued)

FOREIGN PATENT DOCUMENTS

| | | |
|---|---|---|
| EP | 0159286 | 4/1985 |
| EP | 1690795 | 2/2005 |

(Continued)

OTHER PUBLICATIONS

International Search Report and Written Opinion, PCT/US2012/049638, mailed Oct. 18, 2012, 10 pages.

*Primary Examiner* — Matthew Luu
*Assistant Examiner* — Rut Patel
(74) *Attorney, Agent, or Firm* — Fish & Richardson P.C.

(57) ABSTRACT

An apparatus for printing and activating an adhesive upon labels with fluid activatable adhesive having a print head and a path along which a label travels to the print head for printing on a front surface of the label. The path after printing reverses the orientation of the label to present the back surface of the label to the print head for applying a fluid for activating a layer of adhesive material on back surface of the label prior to the label exiting the apparatus.

22 Claims, 5 Drawing Sheets

(56) References Cited

U.S. PATENT DOCUMENTS

| | | | |
|---|---|---|---|
| 4,548,857 | A | 10/1985 | Galante |
| 4,594,123 | A | 6/1986 | Eder |
| 4,693,210 | A | 9/1987 | DiFrank |
| 4,721,544 | A | 1/1988 | Zodrow et al. |
| 4,838,776 | A | 6/1989 | Hasl |
| 4,841,962 | A | 6/1989 | Berg et al. |
| 4,927,709 | A | 5/1990 | Parker et al. |
| 4,935,300 | A | 6/1990 | Parker et al. |
| 5,045,140 | A | 9/1991 | Dickey |
| 5,174,852 | A | 12/1992 | Zepf |
| 5,215,622 | A | 6/1993 | Schmelzer |
| 5,321,933 | A | 6/1994 | Seifert et al. |
| 5,505,956 | A | 4/1996 | Kim et al. |
| 5,512,352 | A | 4/1996 | Haig |
| 5,983,970 | A | 11/1999 | Trygg |
| 6,656,319 | B1 | 12/2003 | Boyd et al. |
| 6,849,147 | B2 | 2/2005 | Havard et al. |
| 6,855,226 | B2 | 2/2005 | Hill, IV et al. |
| 6,939,428 | B2 | 9/2005 | Hill, IV et al. |
| 7,074,295 | B2 | 7/2006 | Bellafore et al. |
| 7,229,517 | B2 | 6/2007 | Bellafore et al. |
| 8,142,604 | B2 | 3/2012 | Rehkugler et al. |
| 2004/0134606 | A1 | 7/2004 | Tsutsui |
| 2004/0182510 | A1 | 9/2004 | Pfiefer et al. |
| 2004/0200566 | A1 | 10/2004 | Bellafore et al. |
| 2005/0284566 | A1 | 12/2005 | Wagner et al. |
| 2006/0062623 | A1 | 3/2006 | Kohira |
| 2007/0119542 | A1 | 5/2007 | Williams et al. |
| 2007/0279465 | A1 | 12/2007 | Shindo |
| 2008/0226907 | A1 | 9/2008 | Suhner |
| 2009/0133831 | A1 | 5/2009 | Rehkugler et al. |
| 2010/0085410 | A1 | 4/2010 | Dashiell et al. |
| 2011/0033698 | A1 | 2/2011 | Woods et al. |
| 2011/0061802 | A1* | 3/2011 | Raming ..... 156/256 |

FOREIGN PATENT DOCUMENTS

| | | |
|---|---|---|
| JP | 08133249 | 5/1996 |
| WO | WO2009070395 | 6/2009 |

* cited by examiner

LINER-FREE LABEL PRINTER WITH LABEL ADHESIVE ACTIVATION

This application claims the benefit of priority to U.S. Provisional Patent Application No. 61/574,510, filed Aug. 4, 2011, which is herein incorporate by reference.

FIELD OF INVENTION

The present invention relates to a liner-free label printing apparatus (system and method), and particularly to a liner-free label printing apparatus using a common print head or array of print heads for both printing on front side or surface of a liner-free label and application of a fluid (e.g., solvent, liquid, or solution) for activating a layer of material on the back side or surface of the same label to become adhesive. The print head(s) may be inkjet print heads which are utilized at different times both for printing and then applying a fluid for label adhesive activation in the same apparatus housing. The advantage of dual function print head(s) for printing and adhesive application enables miniaturization of the label printer housing, and lower cost by having the same mechanism provide both functions one after the other but along different sides of the same label.

BACKGROUND OF THE INVENTION

U.S. Pat. No. 5,768,991 describes a label printer for printing on liner-free labels having a single label path onto which a printhead prints indicia and the like on the front side of the label, and then downstream along the path a brush moistens an adhesive coating prior to exiting the printer. This requires two separate mechanisms, one for printing and another for adhesive activation. It would be desirable to provide a printer which unlike this patent does not require two separate mechanism, but the same mechanism which can provide both printing and then adhesive activation.

SUMMARY OF THE INVENTION

Accordingly, it is an object of the present invention to provide an apparatus, method, and system for printing having a common print head or print heads for both printing and applying a fluid for activating adhesive of activatable liner-free labels prior to exiting the apparatus.

Briefly described, the present invention embodies an apparatus having a print head, and a path along which a label travels to the print head for printing on a front surface of the label. The path after printing reverses the orientation of the label to present the back surface of the label to the print head for applying a fluid (e.g., liquid or solvent) for activating adhesive material on back surface of the label prior to the label exiting the apparatus.

Preferably, the print head is an inkjet print head having nozzles extending along at least the width of a label which operates as a typical inkjet print head for printing liquids on a label in the form of different color inks, but in which one of such liquids in its reservoir is a fluid for activating adhesive of a liner-free label. Optionally, the print head may have additional nozzle(s) to its nozzles commonly used for application of different color inks or a single color ink for applying a fluid for activating adhesive of a liner-free label. In either case, the print head is considered as having multiple nozzles, in which a first group of one or more such nozzles provides one or more inks for enabling printing by the print head, and a second group of one more such nozzles provides such fluid from the print head for activating the adhesive material of the label.

The print head moves with respect to the label when printing or when applying label adhesive activating fluid. Preferably, a single print head is used having nozzles activatable for applying ink(s) for printing and label adhesive activating fluid, where the print head extends at least the width of the label. However, such print head may represent multiple different print heads disposed along a common side of the path of the label.

The print head may print a single or multiple color images or text, and label adhesive activating fluid when the front and back surface or sides of the label, respectively, are presented to the print head. Labels may be supplied in the apparatus from a stack of one or more individual labels, or each label may be cut from either a roll, or a fan-folded continuous stack of label stock or web.

The liner-free adhesive labels used in the apparatus each consist of a facesheet that is coated with a polymer type adhesive which possesses no tack in its dry or non-activated state, and a front printable surface.

In the apparatus, the liner-free label travels along the path by a first series of rollers to present its front printable surface to the print head for printing, and then the path reorients or inverts the label using a second series of rollers back to the first series of rollers back to the print head for application of the adhesive activating fluid along the label's back side to wet the back side's layer of such fluid activatable adhesive. The addition of the activation fluid to the adhesive layer creates a tacky adhesive label. The label is then expelled from the printer and can be applied to a variety of substrates. During the printing and activation process preferably no internal printer parts come into contact with the activated adhesive layer.

Optionally, the apparatus may operate in a first mode as described above for printing and activating adhesive on a liner-free label, and in a second mode where no printing is carried out upon the front surface of the label, but only for application of a fluid for activating the adhesive of the label prior to exiting the apparatus. Such second mode may be desirable when the labels are already pre-printed, or if blank labels are desired, or when utilizing the labels as adhesive strips or forms for sealing and/or adhering to containers in a manner which may be similar to that of typical adhesive tape.

A method is also provided for printing and activating an adhesive upon labels with fluid activatable adhesive having the steps of: guiding a label along a path to present a front side of the label to a print head; printing one or more inks through a first group of one or more nozzles of the print head when guided along the path to present a front side of the label to the print head; reversing orientation of the label to present the back surface of the label to the print head; and applying a fluid for activating an adhesive along the back side of the label through a second group of one or more nozzles of the print head when the back side of the label is presented to the print head.

A print head is further provided for use in the above apparatus having an inkjet print head having a plurality of nozzles, and a reservoir for supplying at least one fluid to one or more of the nozzles onto a label for activating adhesive material along a surface of the label.

BRIEF DESCRIPTION OF DRAWINGS

The foregoing objects, features and advantages of the invention will become more apparent from a reading of the following description in connection with the accompanying drawings, in which.

DETAILED DESCRIPTION OF THE INVENTION

Figure 1:
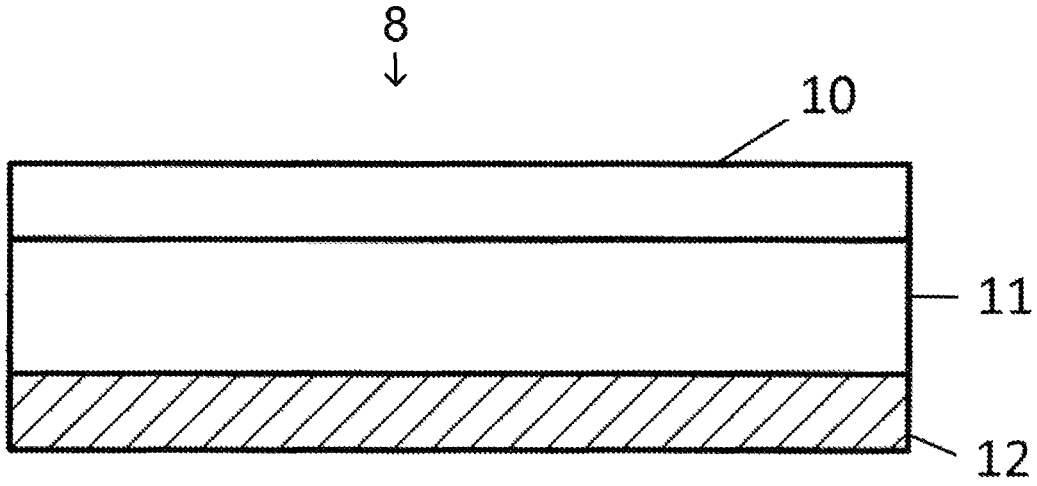
FIG. 1 is a cross-sectional schematic diagram of a fluid activatable adhesive label.

Referring to FIG. 1, a cross-sectional diagram of a liner-free fluid activatable label 8 in shown. The label 8 is composed of a piece of paper 11 having a front side or surface 10 typically coated with a specialty coating to enable the label to effectively absorb inkjet ink, and a back side or surface 12 with a polymer adhesive layer that is non-tacky prior to activation and transitions to a tacky state upon application by an activation fluid (e.g. fluid, solvent, or liquid). The fluid for activating the polymer adhesive layer and the liner-free labels may be the same as described in U.S. patent application Ser. Nos. 12/814,980 or 13/294,438, which are herein incorporated by reference.

The adhesive agent layer along back surface 12 of label 8 mimics the adhesion properties of a pressure sensitive adhesive (PSA) and/or a contact adhesive, but only after the adhesive agent layer has been activated, thereby making tacky the liner-free adhesive label. Activation fluid is for activating the liner-free adhesive layer on back surface 12 of the label 8 provides optimal activation of the adhesive component(s) of the layer of adhesive composition of the liner-free label. The activating fluid composition penetrates into the adhesive layer along back surface 12 to moisten the adhesive components without over-wetting the adhesive surface of the label 8, which can compromise adhesive performance. In addition, the activating fluid is compatible with existing inkjet printer heads allowing its application in a desired amount and pattern. The activation fluid introduces moisture into the adhesive layer to allow for the conversion of the adhesive from its non-tacky to tacky state. Once the adhesive layer is remoistened with the activation fluid, it possesses visco-elastic flow and behaves in a manner very similar to a typical pressure sensitive adhesive. The chemical composition of the adhesive layer dictates the proper solvent selection for the activation fluid.

Suitable fluids for activating the adhesive layer may be as follows: water; acetone; acetonitrile; lower alcohols (i.e., having from 1-10 carbons) including, but not limited to, methanol, ethanol, isopropyl alcohol, n-propanol, n-butanol, 2-butanol, isobutanol, 2-methy-2-butanol, n-pentanol, n-hexanol, 2-hexanol, cyclohexanol, n-heptanol, n-octanol, n-nonanol, n-decanol; glycols including, but not limited to, propylene glycol, ethylene glycol, and butylene glycol; fatty alcohols (i.e., having more than 10 carbons) including, but not limited to, undecanol, dodecanol, 1-tetradecanol, arachidyl alcohol, docosanol, tetracosanol, hexacosanol, octanosol, triacontanol, cetyl alcohol, stearyl alcohol, and polycosinol; ketones, such as methyl ethyl ketone; esters, such as ethyl acetate, mineral spirits; oils, such as linseed oil and vegetable oil; citrus based solvents, such as limonene, other primary, secondary, and tertiary alcohols, and combinations thereof. Less volatile fluids for activating the adhesive layer may also be used, such as ethylene glycol, polyether polyols, phalates, plasticizers and propylene glycol are particularly effective in increasing wet out on hydrophobic surfaces and extending the tacky period after activation.

The polymer selection for the adhesive layer may be such that the activation fluid required to activate the label is water. However, selecting polymers that only require water to rapidly transition from non-tacky to active may not be desirable as the finished labels are highly vulnerable to blocking due to absorption of atmospheric moisture, causing a transition from the non-tacky state to the tacky state, at an undesired time.

To decrease surface tension, enhance fluid spreading on the adhesive film surface, and/or promote activating solvent penetration, surfactants may be added to the activation fluid. Surfactants may also help in the delivery of the activation fluid by allowing for the creation of finer mists with smaller particle sizes during atomization (when used to apply the activation fluid to the adhesive layer of a label) which can promote adhesive activation by increasing the surface area for the interaction between the activating solution and the adhesive layer. Classes of surfactants that can be used include anionic, cationic, non-ionic and amphoteric surfactants. Specific examples include lecithin, Span™-60, Span™-80, Span™-65, Tween™-20, Tween™-40, Tween™-60, Dynol™ 604 (Air Products), Surfynol™ (Air Products), Pluronics™ (BASF, Germany), Polysorbates™ (Tween™), Sodium dodecyl sulfate (sodium lauryl sulfate), Lauryl dimethyl amine oxide, Cetyltrimethylammonium bromide (CTAB), Polyethoxylated alcohols, Polyoxyethylene sorbitan, Octoxynol™ (Triton X100™), N,N-dimethyl-dodecylamine-N-oxide, Hexadecyltrimethylammonium bromide (HTAB), Polyoxyl 10 lauryl ether, Brij™ 721™, Bile salts (sodium deoxycholate, sodium cholate), Polyoxyl castor oil (Cremophor™), Nonylphenol ethoxylate (Tergitol™), Cyclodextrins, Lecithin, or Methylbenzethonium chloride (Hyamine™)

Additives may be incorporated into the activation fluid, such as acids, bases, buffers, antimicrobial agents, stabilizers, emulsifiers, and/or defoaming agents, as needed for the particular application.

Figure 2:
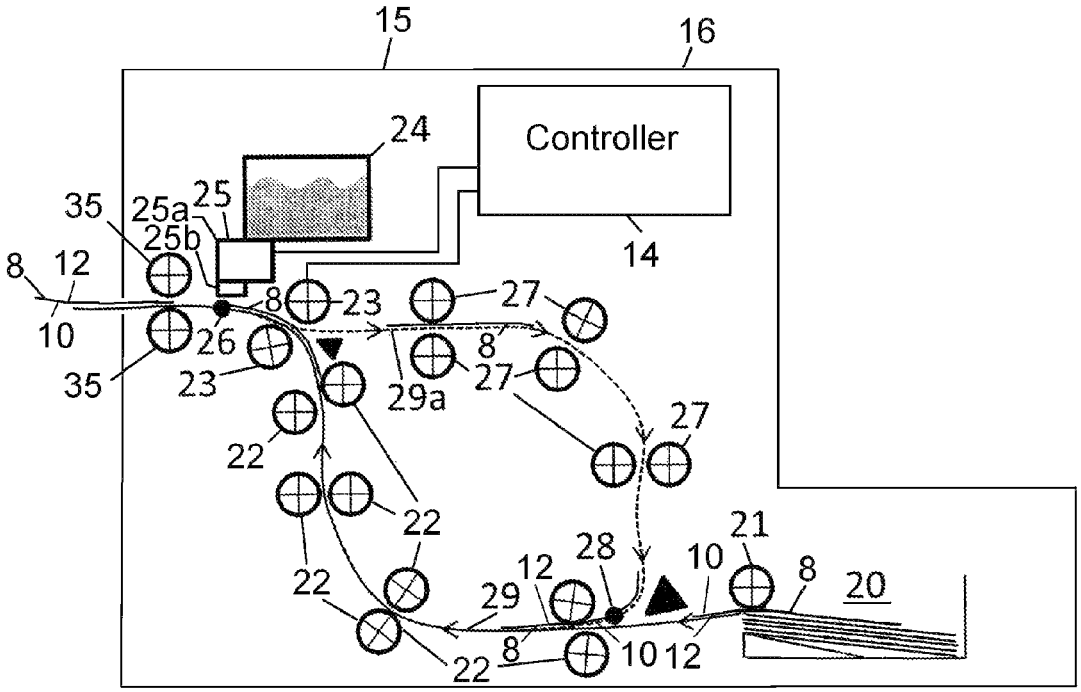
FIG. 2 is a block diagram of the apparatus of the present invention showing the path of a liner-less label through the label printer of the present invention, where the part of the path for reversing the label orientation is shown in dashed lines.

Referring to FIG. 2, an apparatus 10 of the present invention is shown providing both a liner-free label printer and application of a fluid for activating adhesive of labels 8. Sheets of individual labels 8 are stacked in a tray 20. A motorized take up roller 21 guides a label 8 from tray 20 into a path 29. The label 8 is guided or driven along that path 29 by a series of motorized rollers 22 that guide the label to a series of reversible rollers 23. Once the label 8 passes the reversible rollers 23 printing occurs at or prior to the reverse point 26 along path 29 upon front surface 10 of label 8 as it moves along path 29.

Figure 4A:
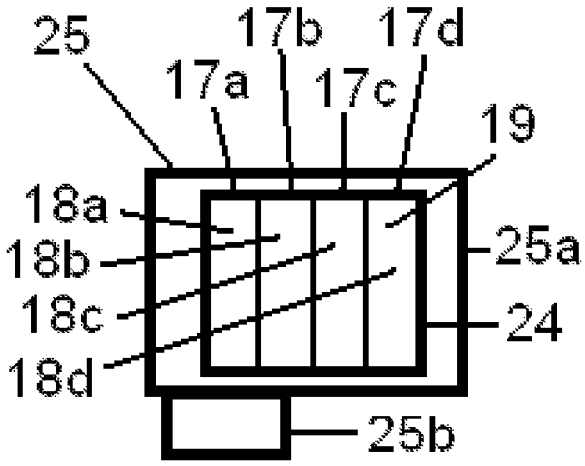
FIGS. 4A and 4B are block diagrams showing a side view and front view, respectively, of print head of FIG. 2 in which the reservoir(s) are within the print head.
Figure 4B:
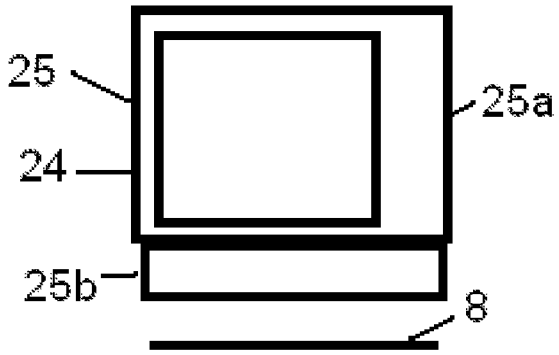

Printing is by a print head 25 having a housing 25*a* with an array of nozzles 25*b* as best shown in FIGS. 4A and 4B. Print head 25 may be a typical print head, such as used in inkjet printers, which extends at least across the width of label 8 as depicted in FIG. 4B. A reservoir 24 is provided having chambers 17*a*, 17*b*, 17*c*, and 17*d* as typical of an inkjet print head for each of the different inks which may be emitted by different one of groups or arrays of nozzle(s) 25*b* (FIG. 4A). The reservoir 24 may instead be considered as being multiple reservoirs 17*a-d*. For purposes of illustration four chambers are depicted in FIG. 4A, but other number of orientation of such chambers may be used depending on the type of inkjet print head. Chambers 17*a-c* each have an inks 18*a*, 18*b*, and 18*c* of desired types, while chamber 17*d* has a fluid 19 for activating adhesive of the label 18 (such fluid 19 is not utilized at this time). Reservoir 24 may be provided within housing 25*a* as shown in FIGS. 4A and 4B or external thereof and coupled or attached thereto as shown in FIG. 2, as typical of different types of inkjet print heads which may be used in apparatus 10. Ink(s) from reservoir 24 is forced through nozzles 25*b* in print head 25 onto the upper surface 10 of label 8 in the same manner as typical of inkjet printing.

After printing occurs, the reversible rollers 23 reverse the direction of the label 9 into a back feed paper path 29*a* so that the orientation is reverse by the time the label reaches point 28 along such path. Thus, front surface 10 and back surface 12 are now switched or inverted in orientation from when the label was original feed from tray 20, as shown in FIG. 2. The back feed paper path 29*a* is guided or driven by motorized back feed guide rollers 27. The back feed guide rollers 27 guide the label 8 to the main path 29 re-entrance point 28. From here the label 8 repeats its previous path 29 along guide rollers 22 until the label 8 crosses beneath the print head 25 for its final pass. As the label passes through the print area where a group or array of nozzles 25*b* are directed towards back surface 12 of label 8 and activation fluid 19 stored in reservoir 24 (chamber 17*d*) is emitted (e.g., sprayed or dropped) through an array nozzles in the print head 25 along the width of the moving label 8 thereby activating the adhesive layer of label 8 in the same manner as typical of inkjet printing. The nozzles 25*b* used for fluid 19 are preferably different than the nozzles utilized earlier for printing on label 8, but may be the same if desired. The label 8 is then emitted from the printer via rollers 35, which may also be motorized. Preferably roller 35 are not present as not to contact the label's now tacky back surface where motion of the label after print head 25 can guide label 9 to at least partially exit (e.g., emitted or ejected) from an opening in the housing 16 for pickup by a user or other or by an automatic application system and applied to a desired substrate.

The mechanism provided by roller 21 from supplying labels 8 from tray 20 may be typical of paper feed mechanisms of desk top or portable printers. Alternatively, such mechanism may supply labels 8 from a roll 30 of web or label stock, as shown for example in FIG. 3, where a cutter 31 is automatically actuated to cut the label 8 to a desired length. This allows for variable length or print to length printing. The size of label 8 may be adjusted in length to fit only the necessary information and therefore eliminate wasted or unprinted space. Label 8 once cut to the desired length by automatic cutting device 31 is guided into path 29 by a motorized take up roller 21. From this point forward the printing and activation process is identical to that depicted in FIG. 2. Rotation of roll 30 may be provided by a motorized shaft along which the roller is disposed, or motorized roller(s) between the cutter device 31 and roll 30 mounted along a shaft for rotation. Optionally the roll 30 may be replaced by a continuous fan-folded stack of web or label stock.

Although pairs of rollers on opposite sides of path of label are shown in FIG. 2 and are described as motorized, both rollers of the pair may be motorized, or one motorized and the other rotatable in response to label passing between the pair of rollers. Each pair of rollers are spaced from each other and motor driven to move the label along its path and thus may be the same or similar to rollers such as used in typical label printers. Other label drive mechanisms in apparatus 10 may also be used typical of desktop or portable printers for labels or other media which are operated herein to guide label 8 as described above. Thus, the mechanism for moving label 8 should not be limited to that described herein.

As stated earlier, print head 35 has nozzles (or elements) 25*b* utilizing inkjet printing technology and inkjet print heads, which may be the may be the same as typically used in inkjet printers. In summary, an inkjet print head is an array of small nozzles containing either a piezo-electronic or thermal based driver used to force ink from a reservoir, through the nozzle, and onto a desired medium. Software drivers are used to control which nozzles are active at a specific time. In drop on demand inkjet printing small droplets of ink are selectively emitted through a nozzle and onto the desired medium. The amount of fluid propelled onto the label 8 is determined by the printer driver software that dictates which nozzles emit droplets and how frequently they do so. Either thermal or piezoelectric driven inkjet systems can be used.

Print head 25 may be a typical inkjet printing system containing four individual reservoirs, such as schematically illustrated as chambers 17*a-d* of FIG. 4A, connected to four individual arrays of nozzles 25*b*. In a typical orientation, there is a nozzle array each for black, cyan, magenta, and yellow inks. Other colors are formed by the mixing of the inks on the printed substrate after they have been emitted from the appropriate nozzle(s). Apparatus 10 thus utilizes inkjet print head technology to apply the activation fluid to the adhesive layer of a solvent-sensitive liner-free label. Such being accomplished herein by using a print head having four color inkjet nozzle arrays and replacing one of the colors with activation fluid, such as depicted also in FIG. 4A. Optionally, print head 25 may use more than four inks. For example, print head 25 may have five individual reservoirs connected to five inkjet arrays of nozzles—the five individual reservoirs containing one of the following: cyan ink, magenta ink, yellow ink, activation fluid, and black ink—can be used to apply aqueous pigment or dye based inks to one side of the label during the label's first pass through the print area of the fixed print head, fixed print head array, traveling print head, or traveling print head arrays, and then for application of activation fluid to the back side of the label.

The activation fluid 19 provided by the inkjet print head 25 to label 8 may be applied in a uniform pattern with coverage of 9.8 milliliters per square meter (~0.15 ml per 24 square inches). Alternatively, the fluid 19 is applied in a grid pattern with coverage of 5.0 milliliters per square meter. In yet another alternative, the fluid 19 is applied in a specific pattern as to only create adhesive areas corresponding to specific geographies of a substrate to which adhesion upon is desired. This is enabled by selection of nozzles used to apply fluid 19 with movement of label 8 and print head 25 with respect to each other.

Figure 4C:
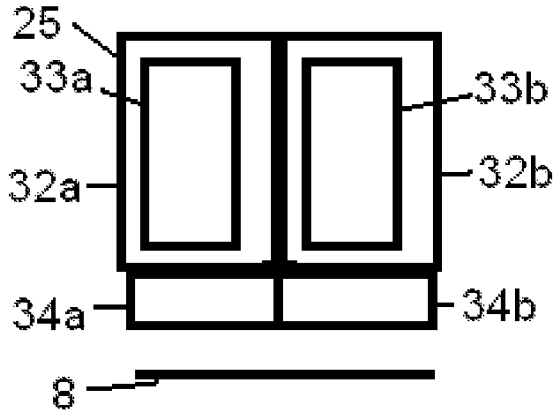
FIG. 4C is a block diagram front view of a print head of FIG. 2 in which the print head in provided by two side by side print heads.

Referring to FIG. 4C, print head 25 may be provided by multiple print heads, such as two print heads 32*a* and 32*b*, respectively, having reservoirs 33*a* and 33*b*, and nozzles 34*a* and 34*b*, respectively. Print heads 32*a* and 32*b* are in side by side relationship so that at least the entire width of the label 8 is presented to their respective nozzles. For example, when label is 4 inches in width, array of nozzles 25*b* of FIG. 4B must extend at least four inches across the width, or two sets of nozzles 34*a* and 34*b* of FIG. 4C are each at least 2 inches in width so that together they provide nozzles extending along the minimum label width. In this case, operation of the print head 25 composed of nozzles of print heads 32*a* and 32*b* by controller 14 is otherwise the same as describe earlier by selection of desired nozzles for facilitating printing or fluid 19 applications. More than two side by side print heads may similarly be used.

Figure 4D:
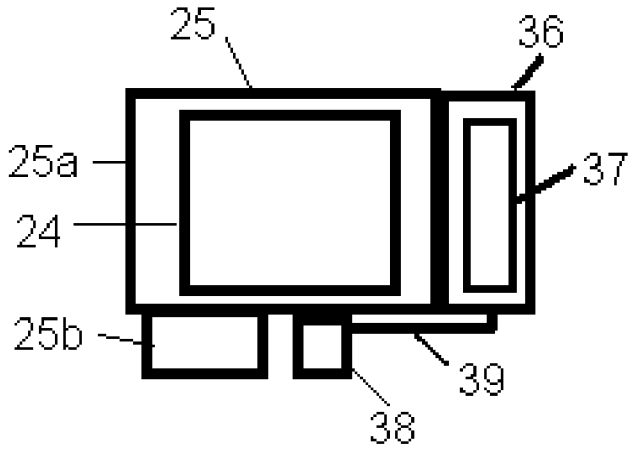
FIG. 4D is a block diagram side view of the print head of FIG. 1 in the case where nozzle(s) provided for spraying the adhesive activation fluid are separated from the nozzle(s) of the print head providing ink(s)

An alterative print head 25 is shown in FIG. 4D which is the same as shown in FIGS. 4A and 4B, but where instead of nozzles 25*b* being used to apply activation fluid for label 8, nozzle(s) 28 are provided to enable such application which are coupled via tube 39 to a reservoir 37 of external housing 36 of print head 25. In this case, operation of the print head 25 nozzles 25*b* and 38 by controller 14 is otherwise the same as describe earlier by selection of desired nozzles for facilitating printing or fluid 19 applications. As such an addition nozzle array is provided specifically for the delivery of the activation fluid.

Optionally, print head 25 may have a first print head of FIG. 4A, 4B, or 4C which do provide a fluid for activating label adhesive, and a second print head of the type of FIG. 4A, 4B, or 4C which provides fluid for activating label adhesive, where each of the first and second print heads each extend at least the width of the label moving with respect to such first and second print heads disposed adjacent each other along a common side of the path of the label.

Figure 4E:
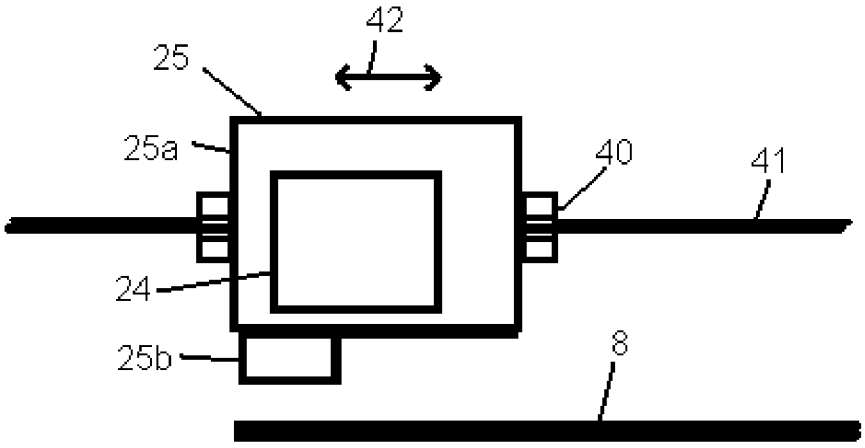
FIG. 4E is a block diagram side view of a print head mounted on a movable carriage.

Although print head 25 is shown stationary or fixed with respect to horizontal movement of label 8, optionally print head 25 or heads described above may be movable with respect to label 8 as shown for example in FIG. 4E. As typical of desk top inkjet printers, print head 25 is attached to carriage 40 movable along a bar 41, such as shown by arrow 42, and apparatus 10 has electronics and components of typical of inkjet printers with movable print head(s). Label 8 may move stepwise or continuous with respect to print head 25 via rollers 23 under controller 14 control. A moveable print head may be useful when the width of nozzles 25*b* is less than the entire width of label 8, so that movement can cover at least the entire width of the label 8. As such nozzles 25*b* (or nozzles 25*b* and 38) can be either fixed or attached to traveling carriage 14, so that either traveling or fixed inkjet arrays can be used to deliver the fluid to the adhesive layer of label 8. Other mechanisms typically used for moving a print head may be used instead of such shown in FIG. 4E, such as a motorized print head stage.

Preferably, the print head 25 is a wide fixed inkjet print head as shown for example in FIG. 4B which extends at least the width of the maximum width of labels for the printer. The print head 25 has a first set or group of nozzles selectable for applying ink along the label's width as its front side 10 passes before the inkjet head 25, and a second group or set of nozzles selectable for applying adhesive activation fluid along the label's width to enable adequate wetting of the label's back side 12 for desired adhesiveness in accordance with the speed of the label 8 passing below the second set of nozzles, nozzle size and flow rate of pressurized liquid there through.

Activation of the adhesive layer of the label 8 by fluid 19 is provided preferably by an inkjet print head as described above. The print head 25, reservoir 24, may be provided by a inkjet printing system having software and hardware as typically used in inkjet printers. As such the print engine (hardware and software) is provided in a controller 14 (or may be a separate controller in communication with controller 14) to control operation of the print head 25 for printing. The same or another engine may be used to control operation of the same head 25 for applying adhesive actuation fluid.

Figure 3:
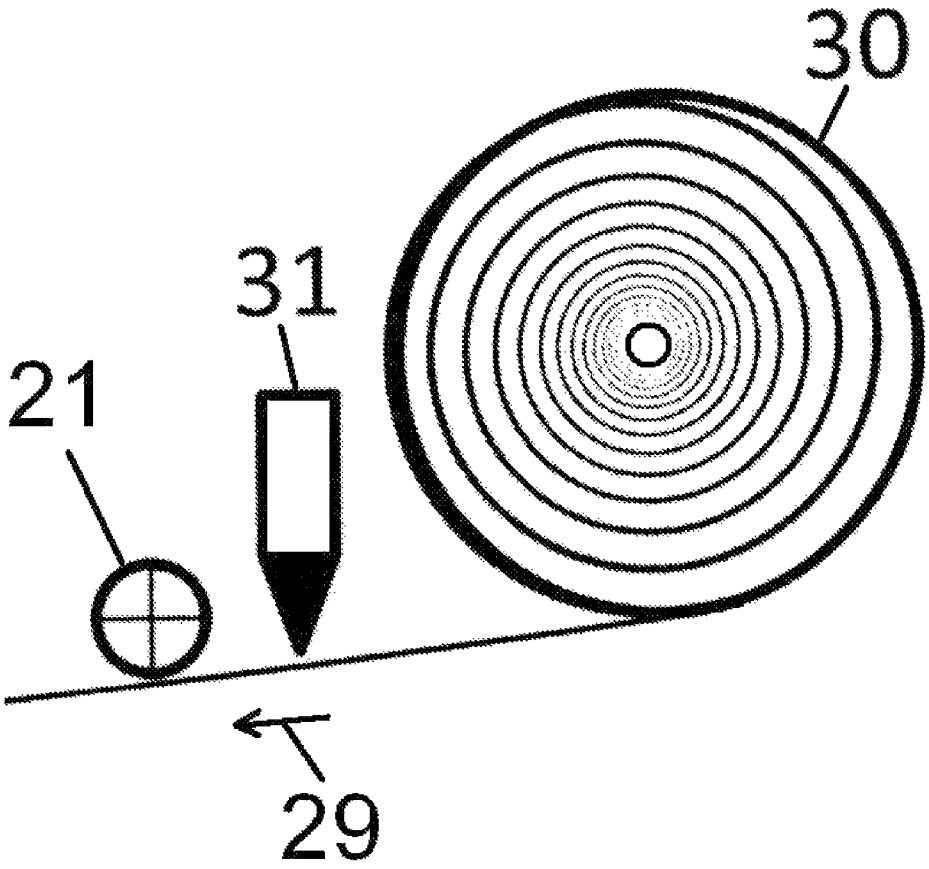
FIG. 3 is a block diagram of another type of mechanism for supplying labels in the apparatus of FIG. 2 where the label is cut from a roll of wound label stock, rather than feed from a stack of labels as shown in FIG. 2.

Controller 14 may be a programmed microprocessor, processor, or the like, which is in apparatus housing 16 (or connected to apparatus 25) to control its operation to enable printing and fluid 19 application. Controller 25 also is programmed to control all other operations of apparatus 10, and as such is connected to motorized reversable roller 23 to control their activation and direction to drive label along path 29 or path 29*a* as descibed above, and also actuation of motorized roller 21 for label feeding. Sensors (optical or mechanical) may provide signals to the controller as to location of a label along its path, and when motor(s) coupled to roller(s) should be actuated and in the direction needed to move the label forward or to reverse the orientation of the label as described earlier. Such sensors may be are present at points 26 and 28 to determine the presence or absence of a label along paths 29 and 29*a*. If supply mechanism of FIG. 3 is present, controller 12 also controls operation of cutter 31 to provide labels of desired widths, as well rotation of motor for roll 30. The electronics and path control mechanisms utilized in apparatus 10 may be the same or similar to U.S. Pat. Nos. 6,805,508 or 7,374,281 in which their rollers and housings are sized for the typical labels, and an additional reservoir is provided to the ink reservoir(s) and coupled to the nozzle(s) for enabling spraying of ink droplets or spraying of the adhesive activation fluid to enable dual mode functionality of the print head of the present invention as described herein. U.S. Pat. Nos. 6,805,508 and 7,374,281 are herein incorporated by reference.

Thus in print head 25 described above, there is programmed selection by controller 14 enabling operation of the first or second group of nozzles 25*b* when the front or back sides, respectively, of the label passes by along its path as described above. Preferably, the print engine may be such as typical used in a fixed inkjet head for controlling release of ink from nozzles. A preferred fixed print head and print engine for apparatus 10 is manufactured by MemJet (San Diego, Calif., USA), but other fixed print head and print engines may be used. Another example of a commercial inkjet printer utilizing fixed print head is the AstroJet M1 (Astro Machine Corporation, Ill., USA).

For example, print head(s) may be the disposable Hewlett-Packard P940 Magenta/Cyan OfficeJet print head, or the print head or print head array described in U.S. Pat. Nos. 0,147,056A1, 0,280,670 A1, and/or 6,543,887 B2. Commercial analogs of inkjet print heads capable of delivering said inks and/or fluids are commonly available from companies including Hewlett-Packard Company (Palo Alto, Calif., USA), Brother Industries, Ltd. (Nagoya, Japan), Canon, Inc. (Tokyo, Japan), and/or Seiko Epson Corporation (Tokyo, Japan). Less preferably, the inkjet print heads, controllers, and software accompanying the Hewlett-Packard OfficeJet 6500 E709n Series (Hewlett-Packard, Palo Alto, Calif.) may be operated to function to deliver ink and/or activation fluid to the liner-free solvent-sensitive label. This utilizes a traveling carriage inkjet type print head array.

In summary, the present invention utilizes automatic reversing the orientation of the liner-free label 8. Unlike the prior art automated duplex printing on media, such as paper, where two-sided printing is provided using only one set of print heads, the present invention does not print on the reverse side of the media printing, but using the same mechanism used for printing to apply a fluid for activating the adhesive of the liner-free label 8. The first pass of the media through the print area of the print head(s) 25 is used to print an image or text onto one side of the label. The second pass—the inverted pass—is used to apply activation fluid to the solvent-sensitive polymer adhesive layer of the label. Ink can also be applied during this pass to place an image on the backside of the label. This is particularly applicable to the labeling of clear substrates, such as plastic bottles. After the activation fluid is applied to the adhesive layer, the adhesive layer transitions from its dry and non-tacky state to its active and tacky state and can be applied to a desired substrate.

From the foregoing description, it will be apparent that there has been provided a label printing apparatus which both prints and applies fluid for activating adhesive of labels using the same print head(s). Variations and modifications in the herein described improvement, method, or system will undoubtedly suggest themselves to those skilled in the art. Accordingly, the foregoing description should be taken as illustrative and not in a limiting sense.

The invention claimed is:

1. An apparatus for printing and activating an adhesive upon labels comprising:

a print head;

a path along which a label travels to said print head for printing on a front surface of said label; and said path after said printing reverses the orientation of said label to present the back surface of said label to said print head for applying a fluid for activating a layer of adhesive material on back surface of said label prior to said label exiting said apparatus, wherein said print head comprises a plurality of nozzles, a first group of one or more of said nozzles provides one or more inks for enabling printing, and a second group of one or more of said nozzles provides said fluid.

2. The apparatus according to claim 1 wherein said print head is an inkjet print head.

3. The apparatus according to claim 1 further comprising a reservoir for supplying said fluid and each of said one or more inks.

4. The apparatus according to claim 3 said print head having a housing and said reservoir being within said housing.

5. The apparatus according to claim 3 said print head having a housing attached to said reservoir.

6. The apparatus according to claim 1 further comprising a first reservoir for supplying each of said one or more inks to said first group of one or more said nozzles, and a second reservoir apart from said first reservoir supplying said fluid for second group of one more said nozzles.

7. The apparatus according to claim 1 wherein said first group and said second group are provided by different ones of said plurality of nozzles.

8. The apparatus according to claim 1 wherein said print head is stationary.

9. The apparatus according to claim 1 wherein said print head is attached to a carriage which moves said print head with respect to said label.

10. The apparatus according to claim 1 wherein said print head extends at least the width of said label.

11. The apparatus according to claim 1 wherein said head represent a plurality of print heads.

12. The apparatus according to claim 11 wherein one or more of said plurality of print heads comprises a first group of one or more nozzles providing one or more inks for enabling printing, and another one or more of said plurality of print heads comprises a second group of one or more nozzles for providing said fluid.

13. The apparatus according to claim 11 wherein said plurality of print heads extend at least the width of the label in side by side relationship.

14. The apparatus according to claim 1 wherein said fluid is applied in one of a uniform, grid, or selected locations or patterns along said back surface of said label when presented thereto.

15. The apparatus according to claim 1 further comprising means for controlling operation of said print head.

16. The apparatus according to claim 1 further comprising means for supplying said label along said path.

17. The apparatus according to claim 16 wherein said means for supplying provides said label from a stack of one or more of said labels.

18. The apparatus according to claim 16 wherein said means for supplying provides said label cut from a roll or continuous folded stack of label stock.

19. The apparatus according to claim 18 wherein different ones of said label are variable in length from each other.

20. The apparatus according to claim 1 wherein said label represents one of a plurality of ones of said label traveling along said path.

21. A method for printing and activating an adhesive upon labels with fluid activatable adhesive comprising the steps of:

guiding a label along a path to present a front side of said label to at least one print head;

printing one or more inks through a first group of one or more nozzles of said print head when guided along said path to present a front side of said label to said print head;

reversing orientation of said label to present the back surface of said label to said print head; and applying a fluid for activating an adhesive along said back side of said label through a second group of one or more nozzles of said print head when said back side of said label is presented to said print head.

22. A system for printing and activating an adhesive upon labels with fluid activatable adhesive comprising the steps of:

means for guiding a label along a first path to present a front side of said label to a head;

means for printing one or more inks through a first group of one or more nozzles of said head when guided along said first path to present a front side of said label to said head;

means for guiding a label for along a second path head after being driven along said first path to reorient said label with respect to said means for guiding said label along said first path so as to enable said back side of said label to be presented to said head; and means for applying a fluid for activating an adhesive along said back side of said label through a second group of one or more nozzles of said head when back side of said label is presented to said head.

* * * * *

UNITED STATES PATENT AND TRADEMARK OFFICE

CERTIFICATE OF CORRECTION

PATENT NO. : 8,939,538 B2
APPLICATION NO. : 13/566959
DATED : January 27, 2015
INVENTOR(S) : Benjamin David Lux It is certified that error appears in the above-identified patent and that said Letters Patent is hereby corrected as shown below:

In the Claims

Column 9, Line 40, In Claim 6, after "one" insert -- or --.

Signed and Sealed this
Fourth Day of August, 2015

Michelle K. Lee

Michelle K. Lee
*Director of the United States Patent and Trademark Office*